US008102131B2

(12) United States Patent
Jakob et al.

(10) Patent No.: US 8,102,131 B2
(45) Date of Patent: Jan. 24, 2012

(54) YARN-TENSIONING DEVICE AND ARRANGEMENT AND METHOD FOR OPERATING A CREEL

(75) Inventors: Alfred Jakob, Niederuzwil (CH); Andreas Kleiner, Niederhelfenschwil (CH)

(73) Assignee: Benninger AG, Uzwil (CH)

( * ) Notice: Subject to any disclaimer, the term of this patent is extended or adjusted under 35 U.S.C. 154(b) by 557 days.

(21) Appl. No.: 12/303,143

(22) PCT Filed: May 3, 2007

(86) PCT No.: PCT/EP2007/054279

§ 371 (c)(1),
(2), (4) Date: Dec. 2, 2008

(87) PCT Pub. No.: WO2007/147672

PCT Pub. Date: Dec. 27, 2007

(65) Prior Publication Data

US 2009/0140094 A1 Jun. 4, 2009

(30) Foreign Application Priority Data

Jun. 23, 2006 (EP) ..... 06115955

(51) Int. Cl.
*B65H 77/00* (2006.01)

(52) U.S. Cl. ..... 318/6; 318/375; 318/376; 318/379; 318/362

(58) Field of Classification Search ..... 318/376, 318/375, 379, 362, 6

See application file for complete search history.

(56) References Cited

U.S. PATENT DOCUMENTS

| | | | | |
|---|---|---|---|---|
| 4,140,382 | A | 2/1979 | Ichiyanagi et al. | |
| 4,413,983 | A | 11/1983 | Young et al. | |
| 5,009,063 | A * | 4/1991 | Yamaguchi et al. | 57/124 |
| 5,655,721 | A * | 8/1997 | Matsuoka | 242/150 R |
| 5,740,666 | A * | 4/1998 | Yamaguchi et al. | 57/264 |
| 5,934,601 | A * | 8/1999 | Migaki et al. | 242/477 |
| 6,175,204 | B1 * | 1/2001 | Calamatas | 318/375 |

FOREIGN PATENT DOCUMENTS

| | | |
|---|---|---|
| CN | 2549025 Y | 5/2003 |
| DE | 4035862 | 6/1991 |
| DE | 4106484 | 9/1992 |
| DE | 4324412 | 1/1995 |
| DE | 19801334 | 7/1999 |
| EP | 0564018 | 10/1993 |
| EP | 0853695 | 7/1998 |
| EP | 0872008 | 11/2003 |
| FR | 2145056 | 2/1973 |
| JP | 02231975 | 9/1990 |
| JP | 2003348868 | 5/2003 |

* cited by examiner

*Primary Examiner* — Walter Benson
*Assistant Examiner* — David Luo
(74) *Attorney, Agent, or Firm* — Shoemaker and Mattare

(57) ABSTRACT

The invention relates to a yarn-tensioning device for producing a specific thread pull on a thread (5) that is unwound from a winding point (7) of a creel (2) and is guided to a warping machine arrangement (1). Said yarn-tensioning device comprises a rotating body (18) which is at least partially wound round by threads and an electric motor (19) which is connected to the rotation body. Said motor (19) is equipped with at least one brake transistor (20) for discharging excess energy produced when the generator of the motor is operated, said brake transistor being able to convert generator energy, arising when the generator is operated, into heat.

11 Claims, 7 Drawing Sheets

B-B

C-C

D-D

E

YARN-TENSIONING DEVICE AND ARRANGEMENT AND METHOD FOR OPERATING A CREEL

Figure 1:
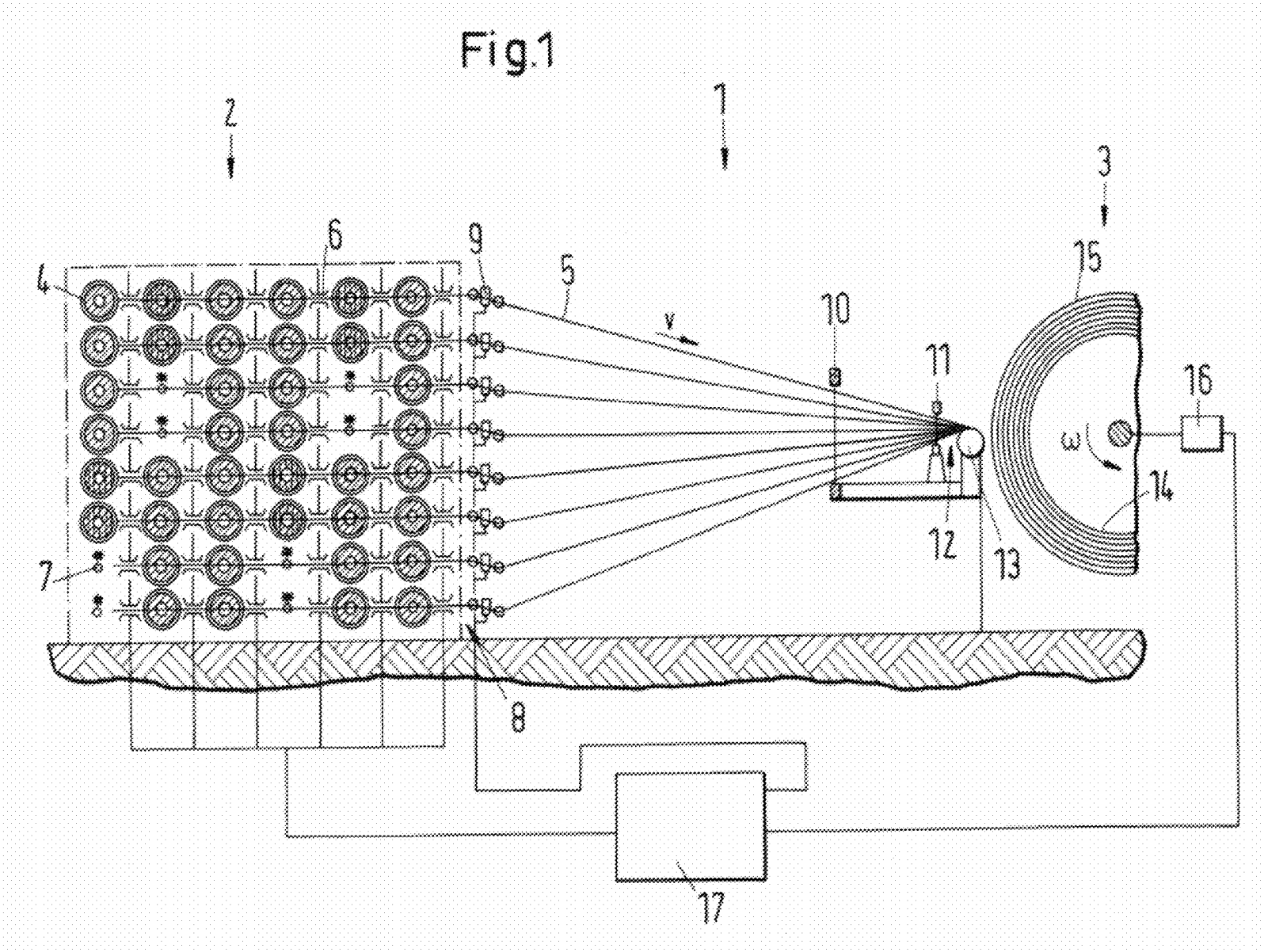

The invention relates to a yarn-tensioning device according to the preamble of claim 1. The invention relates, furthermore, to an arrangement for operating a creel for a winding plant having yarn-tensioning devices according to the invention. The invention then relates to a method for operating a creel for a winding plant according to the preamble of claim 12.

Yarn-tensioning devices with a rotary body, around which a yarn is looped and which is connected to a drive motor in order to set a specific yarn tension, have been known and have been in use for a relatively long period of time. Electric motors employed for this purpose may also be operated as generators. FR 2 145 056 shows, for example, a yarn-tensioning device with a generator and with a yarn wheel connected to the latter. Due to the rotational movement of the yarn wheel as a result of the action of the yarn, a current which is drawn off from an electrical load resistor is generated in a generator, thus giving rise to a load moment. A braking action thus occurs which reacts on the yarn tension of the yarn. It has been shown, in practice, that it may be difficult to handle the current generated in the generator mode.

An object of the present invention, therefore, is to avoid the disadvantages of what is known, in particular to provide a yarn-tensioning device of the type initially mentioned which can be handled simply, as far as possible, in all operating states. Further, it is to be capable of being produced in a simple way and is to be distinguished by cost benefits.

These objects are achieved, according to the invention, by means of a yarn-tensioning device which has the features in claim 1. To brake the yarn or to generate the yarn tension, the motor, as a rule, is in the generator mode. The excess energy occurring in the form of generator current in the generator mode can be discharged in a simple way with the aid of the brake transistor. Such brake transistors which can convert electrical energy into heat are known to a person skilled in the art from other fields of use. To simplify the mounting of the brake transistors, it may be advantageous if commercially available transistors with an insulated housing are used. To generate a specific yarn tension, the motor may, of course, also be operated in specific instances (for example, during the start-up of the winding body) as a drive motor which would then actively drive the rotary body. Various types of electric motors may be used as motors which can also be operated as generators. Such a motor may be, for example, a stepping motor or a direct-current motor. It is advantageous, however, if the motor is a brushless DC motor ("BLDC" in brief). This motor is distinguished by a particularly broad range of use.

In a first embodiment, the brake transistor may be arranged in the region of that side of the motor which faces the rotary body. The advantage of this arrangement is that the heat occurring due to the brake transistor can be diverted away from the yarn-tensioning device efficiently. A diversion of the heat by convection can be improved considerably owing to the high rotational speeds of the rotary body.

It may be advantageous if the motor has a motor housing with an end face, through which a motor shaft is led. In this case, the rotary body fastened to the motor shaft may be arranged on the outside of the end face and the brake transistor may be arranged on the inside of the end face.

The brake transistor may be attached to a circuit board which is fastened to the inside of the end face of the motor housing, in which case the brake transistor may lie between the circuit board and the inside of the end face of the motor housing. A circuit board of this type may consist of an electrically insulating carrier material, to which electrically conductive layers (for example, copper layers) are applied at least in part regions. The circuit board is preferably of disk-shaped design.

The brake transistor may have a top side which forms a contact face with the inside of the end face of the motor housing, with the result that heat transmission between the brake transistor and the motor housing can be improved. The brake transistor top side facing the inside in this case preferably runs plane-parallel to the inside of the end face of the motor housing. For the compensation of tolerances in the region of the contact face between the brake transistor and the motor housing, a heat-conducting paste may be provided, with the result that heat transmission is further improved. It would also be conceivable, however, to arrange the brake transistor at a shorter distance from the inside of the end face. In this case, the heat-conducting paste would bridge the distance between the brake transistor and the motor housing.

The brake transistor may be mounted on a top side of the circuit board. Electrically conductive conductor means, such as, for example, conductor tracks or conductor bars, may emanate from the brake transistor and are led through the circuit board to the rear side of the circuit board in order to make an operative electrical connection between the brake transistor and motor. For this purpose, corresponding bores through which the conductor means can be led may be provided in the circuit board.

The free ends of the conductor means on the rear side of the circuit board may form contact feet which can be in electrical contact with a circuit board for the motor control or with the motor control. The activation of the brake transistors can be controlled with the aid of the motor control.

It may be advantageous, further, if at least two brake transistors are provided in the yarn-tensioning device. Of course, even a multiplicity of brake transistors may be used. The choice of the number of transistors depends essentially on the heating capacity of the transistor.

The rotary body may be designed as a yarn wheel, in the circumferential region of which an approximately V-shaped groove for receiving the yarn is provided. A yarn wheel of this type is shown, for example, in FR 2 145 056.

The yarn wheel may be configured in two parts so as to be capable of being assembled from yarn wheel disks, in which case the groove may be capable of being formed as a result of the assembling of the yarn wheel disks. To prevent a slip of the yarn on the rotary body, a profiling distributed on the circumference may be provided. A profiling of this type has become known, for example, from U.S. Pat. No. 4,413,981.

To improve the cooling action by the rotating rotary body, the rotary body may have, on the underside facing the motor, at least one vane element for cooling. To intensify the swirling of air for cooling, the rotary body may preferably have a plurality of vane elements which are distributed in an approximately radiating manner on the inside of the rotary body.

A further aspect of the invention relates to an arrangement for operating a creel for a winding plant. An arrangement of this type has become known, for example, from EP 1 162 295. Arrangements of this type may also have a very large number of winding stations and corresponding yarn-tensioning devices. By the yarn-tensioning device according to the invention being used, the investment costs for such an arrangement, in particular a warping plant, can be lowered considerably. The yarn-tensioning devices also have advantages with regard to the maintenance of the arrangement.

A further aspect of the invention then relates to a method according to claim 12.

The use of brake transistors has various advantages. Brake transistors are relatively cost-effective, for example as compared with the use of resistors for the heating of excess energy. The use of brake transistors may also be advantageous in control terms. Yarn-tensioning devices can be operated reliably, and incidents caused by overheated or burning yarn-tensioning devices are virtually ruled out.

Figure 2:
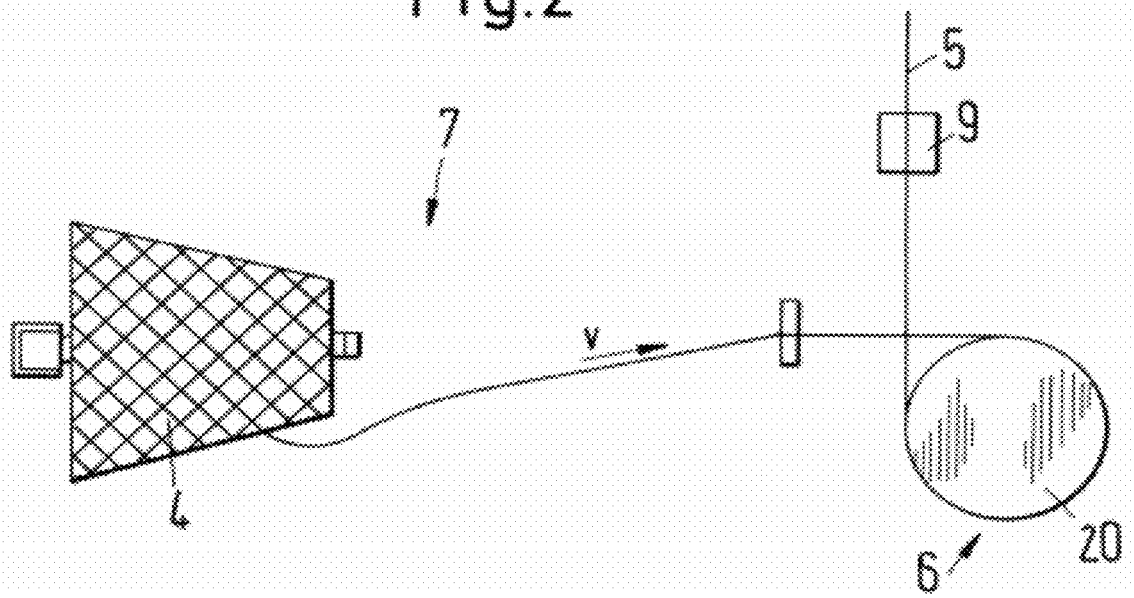
Figure 3:
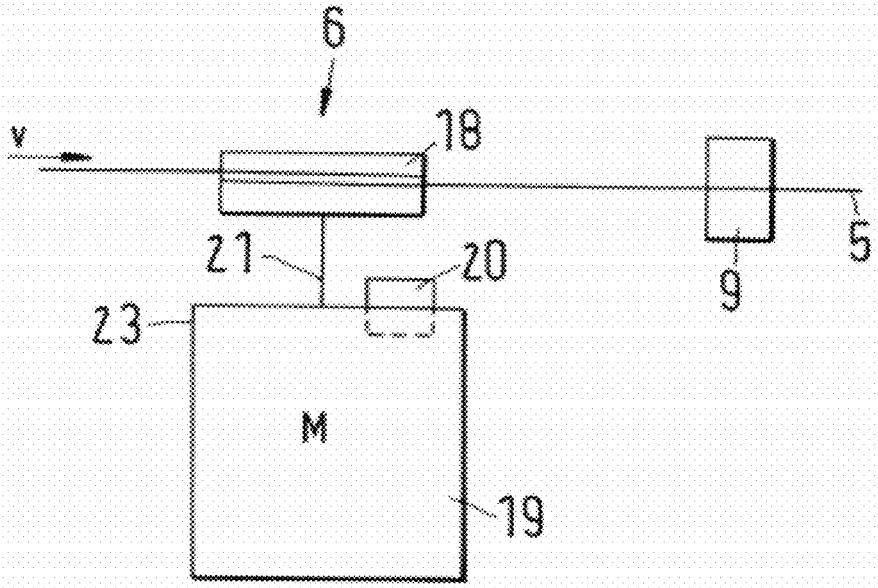
Figure 4:
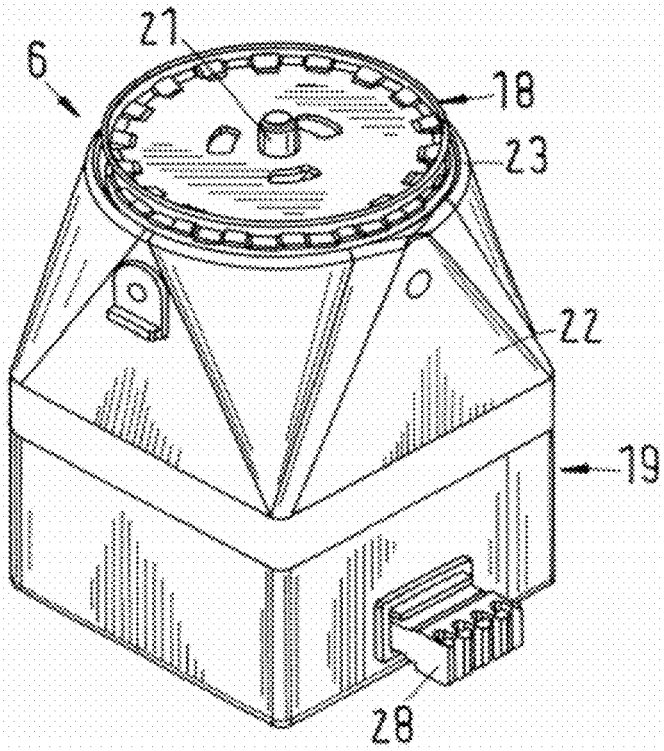
Figure 5:
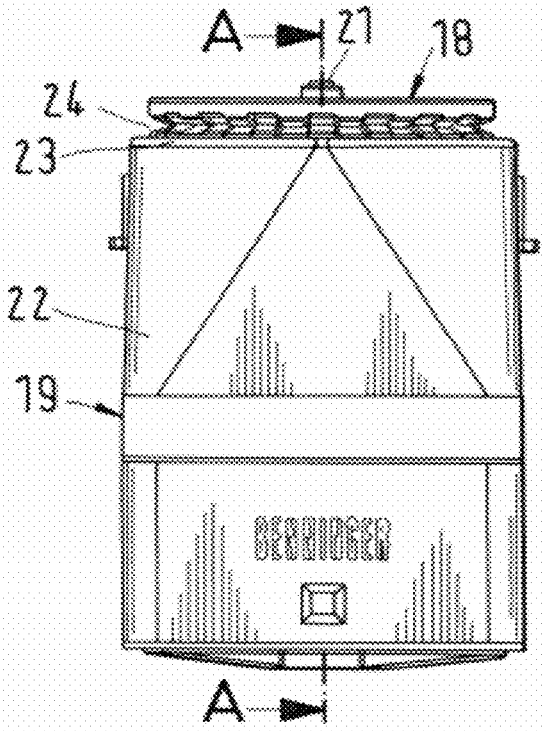
Figure 6:
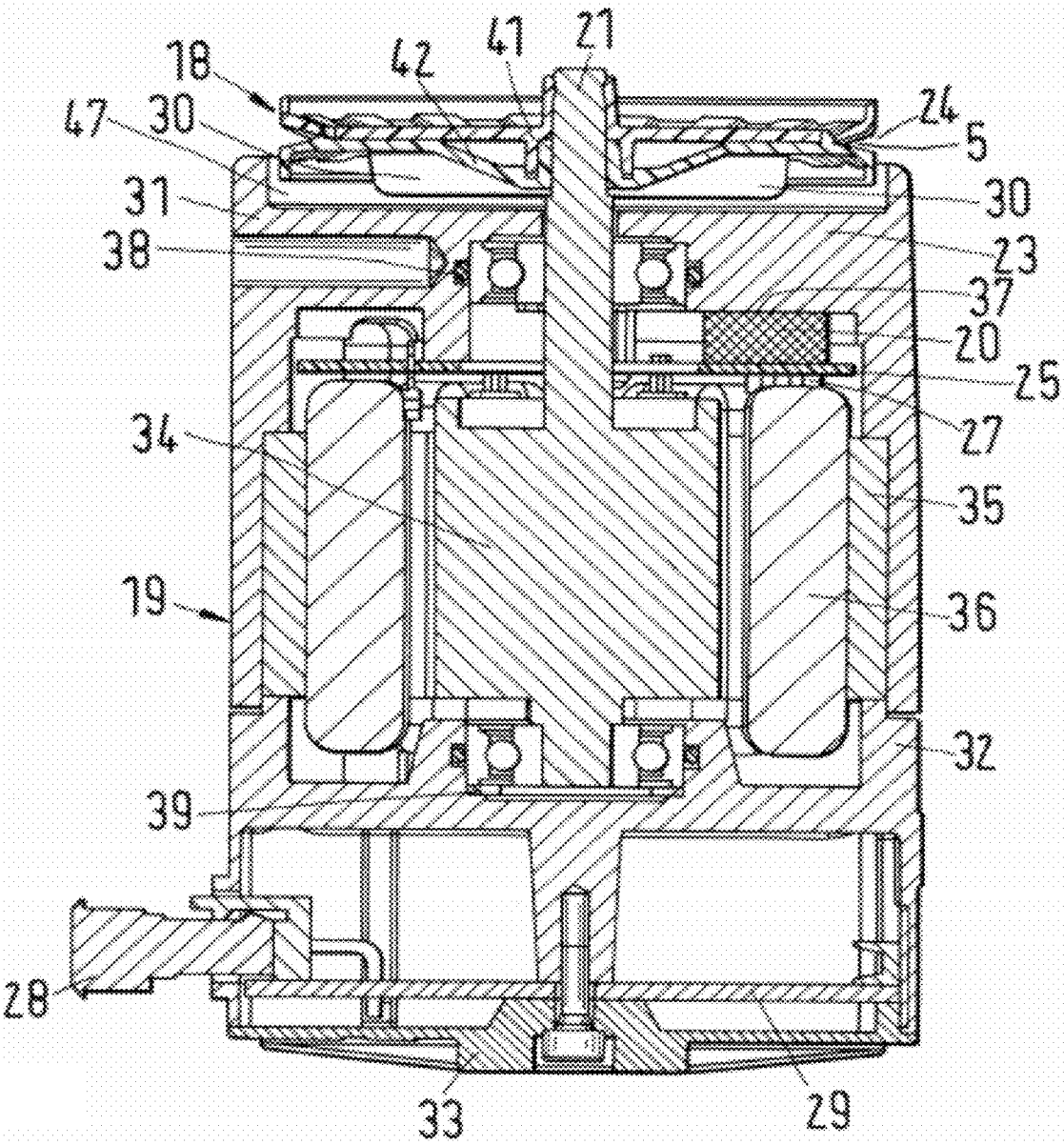
Figure 8:
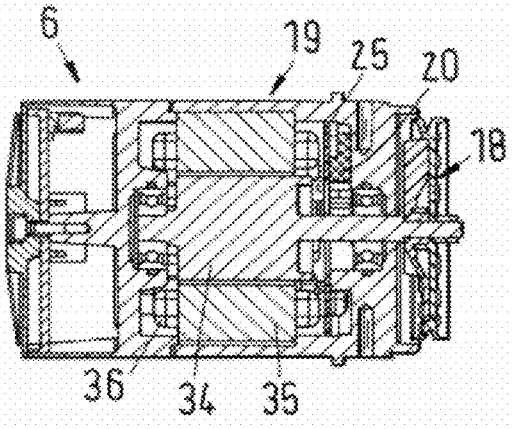
Figure 7:
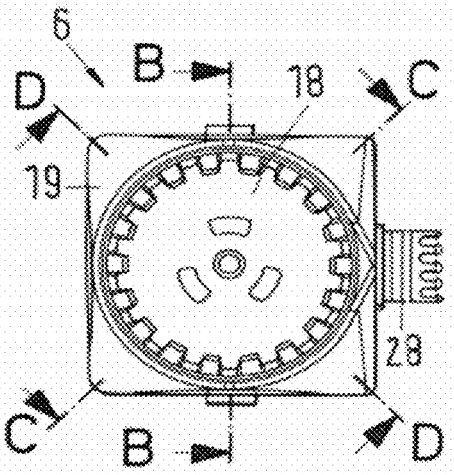
Figure 9:
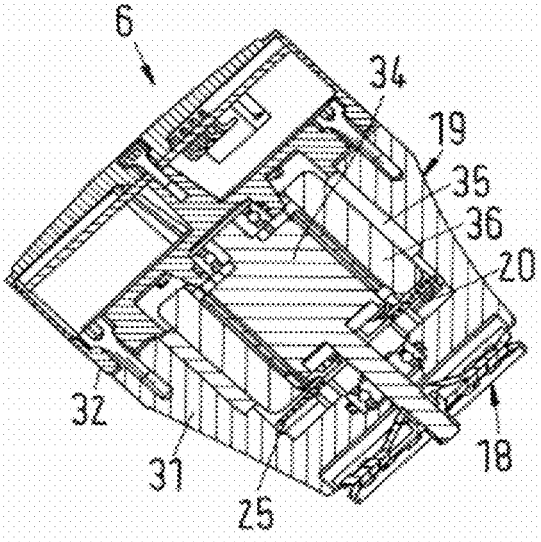
Figure 10:
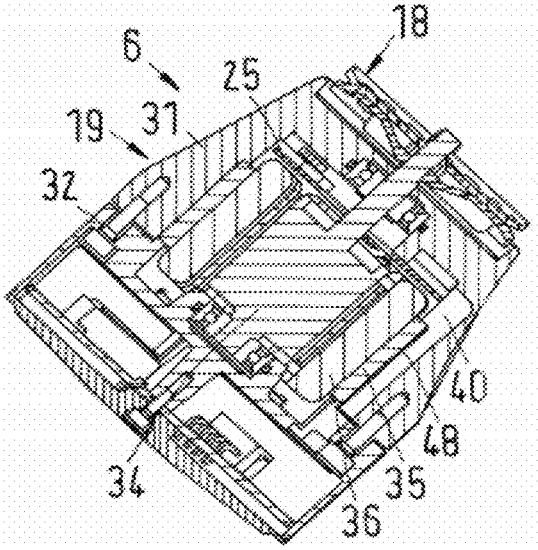
Figure 11:
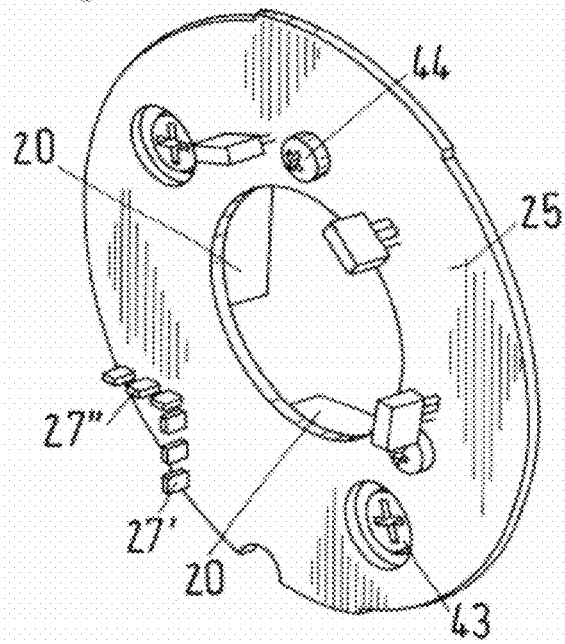
Figure 12:
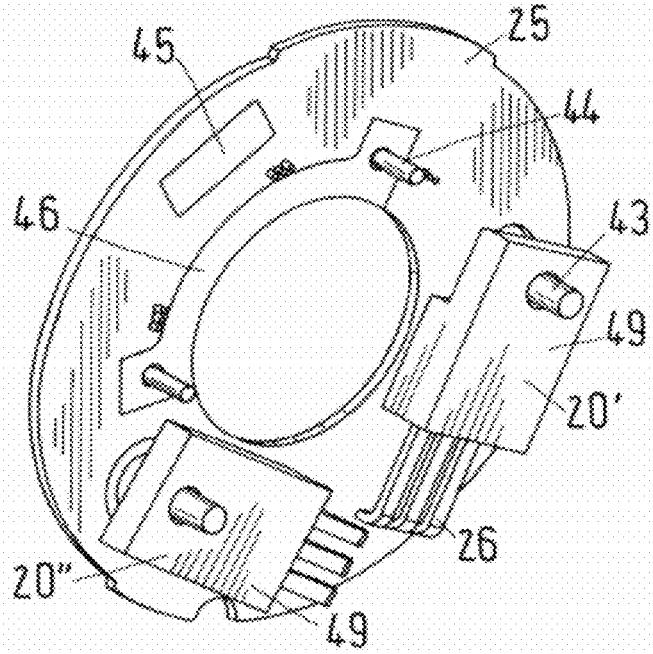
Figure 14:
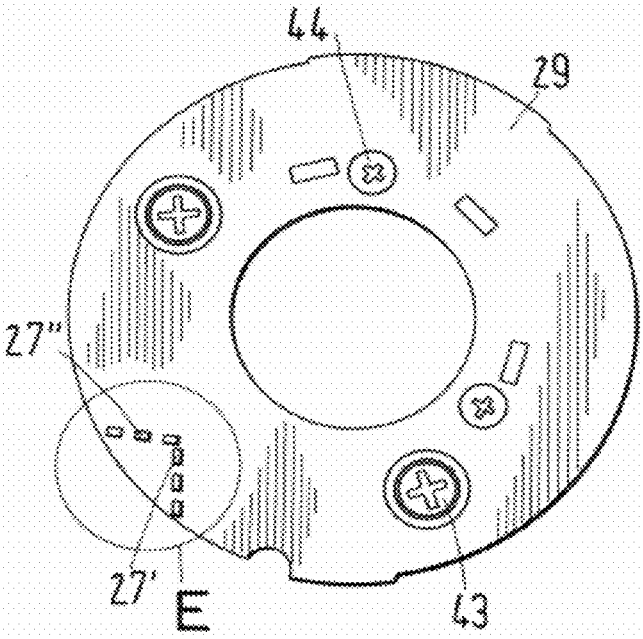
Figure 13:
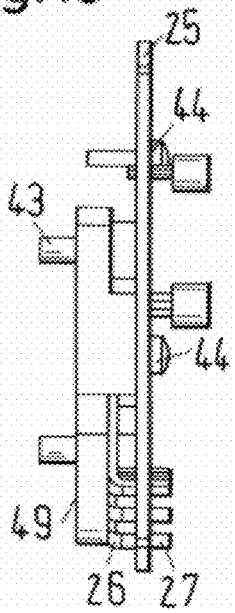
Figure 15:
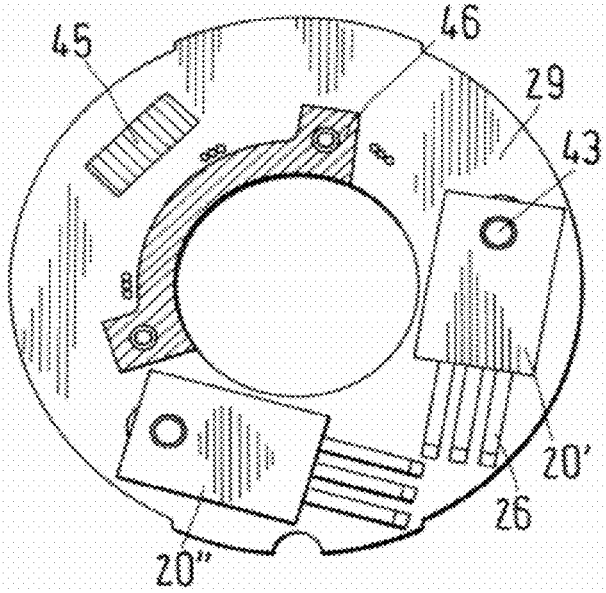
Figure 16:
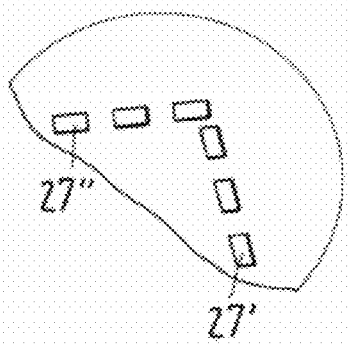

Further advantages and individual features of the invention may be gathered from the following description of exemplary embodiments and from the drawings in which:

FIG. 1 shows a diagrammatic side view of a winding plant with a creel,

FIG. 2 shows a top view of an individual winding station with a yarn-tensioning device and with a yarn sensor, FIG. 3 shows a side view of the yarn-tensioning device and of the yarn sensor according to FIG. 2, FIG. 4 shows a perspective illustration of a yarn-tensioning device, FIG. 5 shows a side view of the yarn-tensioning device according to FIG. 4, FIG. 6 shows a cross section through the yarn-tensioning device according to FIG. 4 (section A-A according to FIG. 5), FIG. 7 shows a top view of the yarn-tensioning device according to FIG. 4, FIG. 8 shows a section through the yarn-tensioning device along the sectional line B-B according to FIG. 7, FIG. 9 shows a section through the yarn-tensioning device along the sectional line C-C according to FIG. 7, FIG. 10 shows a section through the yarn-tensioning device along the sectional line D-D according to FIG. 7, FIG. 11 shows a perspective illustration of a circuit board with two brake transistors for the yarn-tensioning device according to FIG. 4, FIG. 12 shows a perspective illustration of the circuit board according to FIG. 11 from another viewing angle, FIG. 13 shows a side view of the circuit board according to FIG. 11, FIG. 14 shows a top view of the rear side of the circuit board according to FIG. 11, FIG. 15 shows a top view of the front side of the circuit board according to FIG. 11, FIG. 16 shows an enlarged illustration of a detail E from FIG. 14.

FIG. 1 shows a winding plant, designated by 1, for example a warping plant with a creel 2 and with a winding machine 3, for example a cone warping machine. However, warping or beaming machines may, of course, also be envisaged as winding machines. The individual yarn bobbins 4 are attached to winding stations 7 of the creel, and the jointly drawn-off yarns 5 pass in each case through at least one yarn-tensioning device (or yarn brake) 6 in order to maintain a predetermined yarn tension. The example according to FIG. 1 shows a parallel creel. The bobbins in this case form vertical and horizontal rows, in each case a vertical row forming on each creel side a yarn group, of which the yarn running length from the winding station to the winding machine is identical. However, the same principle may also be employed in any other type of creel, for example in a V-creel.

Bobbins of different generic type, for example of different yarn qualities or different yarn colors, can be attached to the creel at different stations independently of the yarn running length. Independently of what is known as creel length compensation, the yarns of different generic type can in each case be exposed to an individual braking force.

In the region of the creel side 8 which lies nearest to the winding machine 3, the yarn tension sensors 9 for each individual yarn are preferably arranged. However, the arrangement of the yarn tension sensors at this location is not mandatory. It would basically be advantageous to bring the yarn tension sensors as near as possible to the winding point of the winding machine.

After leaving the creel, the yarns pass into the region of the winding machine 3 where they first pass through a lease reed 10 in which the yarns acquire their correct sequence. The yarns are subsequently delivered to the warping reed 11 in which they are combined in order subsequently to be wound as a composite yarn structure 12 onto the package 15 or onto the winding beam 14 via a deflecting and/or measuring roller 13.

To operate the creel 2 for the winding plant 1, a control and regulating arrangement 17 is provided. This arrangement 17 is connected to a rotary encoder 16 for the rotation of the winding machine 3. In the highly diagrammatic illustration according to FIG. 1, the arrangement 17 receives on the input side a signal from the rotary encoder 16 and also signals from the tension sensors 9. On the output side, the arrangement 17 is connected to the yarn-tensioning devices 6 which are controlled and regulated by means of a manipulated variable. The input signal provided may be, for example, a signal for the angular speed $\omega$. Particularly suitable as an input signal is a signal for the yarn speed v which can be calculated, for example, from the angular speed $\omega$ and the measured thickness of the package 15. However, the yarn speed v could also be measured directly with the aid of the deflecting roller 13.

In a warping process, it is important that yarns can be drawn off from a creel with a constant yarn tension. This requirement is fulfilled optimally by what are known as dynamic yarn-tensioning devices. Yarn-tensioning devices have proved to be particularly suitable for this purpose which consist essentially of a motor and of a rotary body connected to the latter. Yarn-tensioning devices of this type have become known, for example, from FR 2 145 056 or else from DE 43 420 412 A1. The basic set-up of such a yarn-tensioning device 6 which can be used in a creel for a winding plant, in particular a warping plant, is shown in FIGS. 2 and 3. The rotary body 18 may be configured as a roller or roll around which the yarn can be at least partially looped. In FIG. 2, for example, the yarn 5 is looped around the rotary body 18 with a looping angle of about 270°. As indicated in FIG. 3, however, the yarn 5 may also be looped several times around the rotary body 18. Furthermore, a yarn sensor 9 can be seen.

The rotary body 18 is connected via a motor shaft 21 to an electric motor 19 (FIG. 3). The latter, depending on the operating state, can drive the rotary body 18 in one of the two possible directions of rotation. As a rule, however, the motor 19 can be operated as a generator. In such a generator mode, the motor acts in the same way as an electromagnetic brake. According to the invention, the generator current occurring in the generator mode is converted into heat by means of brake transistors 20, with the result that this excess energy can be discharged. Clearly, the brake transistor 20 is arranged in the region of the side facing the rotary body 18. The rotary body can thus be utilized for cooling, since the swirling of air occurring when the rotary body rotates increases the convection, with the result that the diversion of the heat generated by the brake transistor can be improved considerably.

Various structural details of a preferred yarn-tensioning device can be seen in the following FIGS. 4 to 16. As may be gathered from FIGS. 4 and 5, the motor 19 is surrounded by a motor housing 22. The rotary body 18 for a yarn has an approximately V-shaped groove 24 (FIG. 5) in which a yarn can be received. Furthermore, a profiling can be seen, which serves for ensuring that the yarn can be received without slip by the yarn wheel 18. This profiling is clearly provided by depressions and elevations distributed alternately over the circumference. A yarn wheel having a profiling of this type has become known, for example, from U.S. Pat. No. 4,413,981.

FIG. 6 shows that the motor 19 has a rotor 34 and a stator 35 arranged concentrically around the latter and having stator windings 36. The rotor 34 is clearly mounted rotatably on both sides in the motor housing 22 by means of ball bearings (in particular, grooved ball bearings). Furthermore, O-rings 38 for sealing off the motor are provided in the region of the ball bearings.

A brushless direct-current motor ("BLDC" in brief) has proved to be particularly suitable for use in a yarn-tensioning device for a creel of a winding plant. However, other motors, for example, in particular, direct-current motors with brushes or asynchronous motors, would, of course, also be suitable.

The yarn wheel 18 is fastened to the motor shaft 21 by means of a positive and/or nonpositive connection. The yarn wheel 18 is clearly constructed in two parts and consists of two yarn wheel disks 41 and 42. The yarn wheel 18 is partially countersunk in a circular depression 47 at the end face 32 of the motor housing 22. Such a depression serves for preventing an accidental entangling of a yarn with the motor shaft. It can be seen, further, in FIG. 6 that vane elements 30 are arranged on the underside of the yarn wheel 18. By means of such vane elements, the air flow/air swirling can be intensified considerably by the yarn wheel (rotary body).

The motor housing consists of an upper housing part 31, a lower housing part 32 and of a housing cover 33 which closes the motor housing by means of a central fastening screw. The housing parts preferably consist of aluminum or of another material having high thermal conductivity. A circuit board with a terminal 28 for electrical and/or electronic connection is fixed outwardly in the housing by means of a housing cover 33. Furthermore, screws are indicated in FIG. 6, by means of which the circuit board 25 is fastened to the housing part 31 (cf. FIG. 12-14).

The brake transistor 20 fastened on a circuit board 25 is in electrical contact via conductor means with contact feet 27 with the circuit board 29 on which the motor control is arranged. As shown in FIG. 6, the brake transistor 20 contacts the inside of the end face 23 of the motor housing 22 (housing part 31). To bridge any tolerances in the region of the contact face, a heat-conducting paste, designated by 37, is provided. Owing to the heat-conducting paste, the heat occurring in the generator mode can be efficiently led outward from the brake transistor 20.

FIGS. 8 to 9 show further sections through the yarn-tensioning device 6. A vane element 30 can be seen in section in FIG. 8. FIG. 10 shows a cable duct 48 in which cables can be led through to the circuit board 29. FIGS. 9 and 10 then show that the housing parts 31 and 32 are connected to one another by means of screws.

FIGS. 11 to 15 show the circuit board 29 equipped with brake transistors 20. The screws 43 and 44 shown in FIGS. 11 and 12 and also 13 and 14 serve for fastening the circuit board to the motor housing. As may be gathered from FIG. 12, the fastening screw 43 is led through a brake transistor 20. For this purpose, a corresponding hole is provided in the brake transistor. Conductor means 26 which are led through the circuit board 29 and are configured as bars lead away from the brake transistor 20. The free ends of the conductor means form contact feet 27 for making electrical contact to the electric motor.

Two brake transistors 20 are clearly provided on the circuit board 29 and are identified in FIG. 12 by 20' and 20" (cf. FIG. 11/12 showing the assigned contact feet 27' and 27").

A connecting face 45 for the connection of the circuit board can be seen in FIG. 15. Furthermore, a region, identified by 46, which indicates a bearing face with the inside of the motor housing can be seen. The circuit board 29 is therefore connected directly to the housing solely in the region of this bearing face 46.

The invention claimed is:

1. A yarn-tensioning device for generating a specific yarn tension on a yarn which is drawn off from a winding station of a creel and is delivered to a winding apparatus, said yarn-tensioning device comprising a rotary body around which the yarn can be at least partially looped, and an electric motor which is connected at the rotary body and with the aid of which the rotary body can be driven, said motor having a generating mode, wherein, to discharge excess energy in the generator mode of the motor, the motor is equipped with at least one brake transistor, by means of which electrical current produced in the generator mode can be converted into heat, wherein the brake transistor is arranged on a side of the motor which faces the rotary body, so that air generated by movement of the rotary body cools the brake transistor.

2. The yarn-tensioning device as claimed in claim 1, wherein the brake transistor is mounted on a disk-shaped circuit board which is fastened to the inside of the end face of the motor housing.

3. The yarn-tensioning device as claimed in claim 1, wherein the brake transistor has a top side which forms a contact face with the inside of the end face of the motor housing, and to compensate for tolerances in the region of the contact face, a heat-conducting paste is provided between the brake transistor and the motor housing.

4. The yarn-tensioning device as claimed in claim 1, wherein the brake transistor is mounted on a top side of the circuit board, and conductor means emanate from the brake transistor and are led through the circuit board to the rear side of the circuit board in order to make an operative electrical connection between the brake transistor and motor in the generator mode.

5. The yarn-tensioning device as claimed in claim 4, wherein the free ends of the conductor means form on the rear side of the circuit board contact feet which are in electrical contact with a circuit board for the motor control of the motor.

6. The yarn-tensioning device as claimed in claim 1, wherein two brake transistors are provided.

7. The yarn-tensioning device as claimed in claim 1, wherein the rotary body is designed as a yarn wheel, in the circumferential region of which an approximately V-shaped groove for receiving the yarn is provided.

8. The yarn-tensioning device as claimed in claim 1, wherein the rotary body has, on the underside facing the motor, at least one vane element for cooling in the generator mode.

9. An arrangement for operating a creel for a winding plant having a plurality of winding stations and a winding machine for the joint winding of a plurality of yarns of identical or different generic type which are drawn off from the winding stations, and at least one yarn-tensioning device according to claim 1 assigned to each winding station.

10. A method for operating a creel for a winding plant with a plurality of winding stations, in which a plurality of yarns of identical or different generic type are drawn off jointly from the winding stations by means of a rotating winding machine, at each winding station the yarn being acted upon with a variable braking force in order to generate a specific yarn tension with the aid of at least one yarn-tensioning device according to claim 1.

11. A yarn-tensioning device for generating a specific yarn tension on a yarn which is drawn off from a winding station of a creel and is delivered to a winding apparatus, said yarn-tensioning device comprising a rotary body around which the yarn can be at least partially looped, and an electric motor which is connected at the rotary body and with the aid of which the rotary body can be driven, said motor having a generating mode, wherein, to discharge excess energy in the generator mode of the motor, the motor is equipped with at least one brake transistor, by means of which electrical current produced in the generator mode can be converted into heat, wherein the motor has a motor housing with an end face through which a motor shaft passes, the rotary body fastened to the motor shaft being arranged on the outside of the end face and the brake transistor being arranged on the inside of the end face.

* * * * *

UNITED STATES PATENT AND TRADEMARK OFFICE

CERTIFICATE OF CORRECTION

PATENT NO. : 8,102,131 B2
APPLICATION NO. : 12/303143
DATED : January 24, 2012
INVENTOR(S) : Jakob et al.

It is certified that error appears in the above-identified patent and that said Letters Patent is hereby corrected as shown below:

On the cover of the patent:

(73) Assignee: "Benninger AG, Uzwil (CH)", should read

-- Karl Mayer Textilmaschinen, Uzwil (CH) --

Signed and Sealed this
Thirty-first Day of July, 2012

David J. Kappos

David J. Kappos
*Director of the United States Patent and Trademark Office*